US006951431B2

(12) United States Patent
Rollion

(10) Patent No.: US 6,951,431 B2
(45) Date of Patent: Oct. 4, 2005

(54) HAND-HELD DEVICE FOR APPLYING A FILM ONTO A SUBSTRATE

(75) Inventor: Franck Rollion, Beloy (FR)

(73) Assignee: Societe BIC (FR)

( * ) Notice: Subject to any disclaimer, the term of this patent is extended or adjusted under 35 U.S.C. 154(b) by 0 days.

(21) Appl. No.: 10/424,779

(22) Filed: Apr. 29, 2003

(65) Prior Publication Data

US 2004/0037611 A1 Feb. 26, 2004

Related U.S. Application Data

(63) Continuation of application No. PCT/EP01/08250, filed on Jul. 17, 2001.

(30) Foreign Application Priority Data

Oct. 30, 2000 (EP) ..... 00403016
Dec. 22, 2000 (EP) ..... 00128285

(51) Int. Cl.[7] ..... B43K 7/12; B05C 11/00
(52) U.S. Cl. ..... 401/117; 118/77; 118/78; 118/257
(58) Field of Search ..... 491/117

(56) References Cited

U.S. PATENT DOCUMENTS 3,344,484 A 10/1967 Zepell et al.
5,346,580 A 9/1994 Elges et al.
5,942,036 A * 8/1999 You ..... 118/257
5,967,684 A 10/1999 Huang et al.
6,321,815 B1 * 11/2001 You ..... 156/577
6,510,884 B1 * 1/2003 Chan ..... 156/527

FOREIGN PATENT DOCUMENTS

| | | |
|---|---|---|
| DE | 683614 | 11/1939 |
| JP | 10-330021 | 12/1998 |
| JP | 11 20389 | 1/1999 |
| JP | 2000-238957 | 9/2000 |

OTHER PUBLICATIONS

International Search Report for International Application PCT/EP01/08250.

* cited by examiner

*Primary Examiner*—David J. Walczak
(74) *Attorney, Agent, or Firm*—Jones Day

(57) ABSTRACT

A hand-held device for applying a film of, for example, adhesive, covering, or colored material onto a substrate. The device includes a housing, in which a film material supply is disposed, and an application member with an application end to which the film material can be supplied. The application member is moveable back and forth between a retracted position in the housing and an application position projecting out of the housing through a housing opening. An actuating element is manually moveable between a stand-by position and an active position and activates the application member to move into its application position when it moves into the active position. To improve the operability and handling of the hand-held device, the actuating element is arranged on a side surface of the housing.

29 Claims, 2 Drawing Sheets

HAND-HELD DEVICE FOR APPLYING A FILM ONTO A SUBSTRATE

CROSS-REFERENCE TO RELATED APPLICATIONS

The present application is a continuation of the national stage designation of PCT application No. PCT/EP01/08250 filed Jul. 17, 2001, which claims the benefit of European patent application Nos. EP 00403016.9 and EP 00128285.4, the entire contents of which are incorporated by reference therein.

FIELD OF INVENTION

The invention relates to a hand-held device for applying a film onto a substrate.

BACKGROUND OF THE INVENTION

A hand-held device for applying a film onto a substrate is described in German patent application No. DE 198 24 552 A1. The application member of this hand-held device can move back and forth between a retracted parked position in the housing and an application position projecting out of the housing through an opening in the housing. The application member is attached to a bearing member which also bears the film material supply as well as the application member and is guided so as to be moveable backwards and forwards in the housing in such a way that the application member reaches the two aforementioned positions. An actuating element is provided for moving the movement unit and is comprised of the application member and the bearing member. The actuating element is disposed at the end opposite to the application member, namely at the rear end of the housing. This actuating element is part of the housing and can be moved from a rear stand-by position into a front active position into the housing and back again. A retaining device resembling a ball point pen mechanism is arranged between the actuating element and the bearing member so that, when the actuating element is moved forwards into its active position, the bearing member and the application member are moved into the application position and remain in this position. By pressing the actuating element again in the direction of the bearing member, the retaining mechanism is released and a spring presses the bearing member so far in the direction of the actuating element that the application member finds itself in its parked position retracted in the housing. During the forwards movement, the spring is put under tension.

Improving the operability and handling of a hand-held device of the type described above is desirable.

SUMMARY OF THE INVENTION

The present invention is directed generally to a handheld device for applying a film on a substrate. In one embodiment, the handheld device comprises an actuating element disposed on a side surface of a housing of the hand-held device.

In another embodiment of the invention, the actuating element is disposed in a moveable manner transversely to the direction of movement of the application member or transversely to the longitudinal middle axis of the housing.

The operability of the hand-held device is improved for ergonomic reasons in both of these embodiments of the invention. In one embodiment, the actuating element is located in a position on the side of the housing in which it is more user-friendly to operate, for example with a finger of the user's hand when the hand reaches around the sides of the housing, the fingers of the user's hand also being in a side position so that the actuating element is therefore easier to reach with a finger.

In another embodiment, the actuating element moves in the opposite direction to the fingers of the user's hand because the actuating element can be actuated by the fingers of the user's hand pressing together from both sides of the housing, the finger located opposite or on the other side of the housing also exerting a skewback function and it being possible to retain the housing or the hand held device in a simple manner at the same time as this pressing together movement takes place. The hand-held device can remain between the fingers in its retained position.

Preferably, the embodiments of the invention require just minimal concentration from the person using the device so that this person can concentrate his attention on the application of the film onto the substrate, an action which is desired in order to guarantee defect-free application which, in many cases, needs to be applied accurately and cleanly.

The embodiments of the invention are basically suitable for all known forms of housings and are particularly advantageous for a rod or pen-shaped housing form where the fingers of the user's hand are positioned in a favorable position to both sides of the housing.

A hand-held device as described in the invention is not bound by the type of film which is to be transferred onto the substrate. Within the framework of the invention, this film can have a solid consistency, for example a film which is a coating on a backing tape and can be pulled off this backing tape. However, it can also be a film with a liquid consistency which is applied as a liquid film and then sets, as, for example, is known per se in the application of an adhesive film or a color film.

Features which contribute to making the hand-held device user-friendly, and/or small, can be integrated into or built onto a hand-held device at low costs and also can lead to simple forms which are inexpensive to produce.

DETAILED DESCRIPTION OF THE PREFERRED EMBODIMENTS

Figure 1:
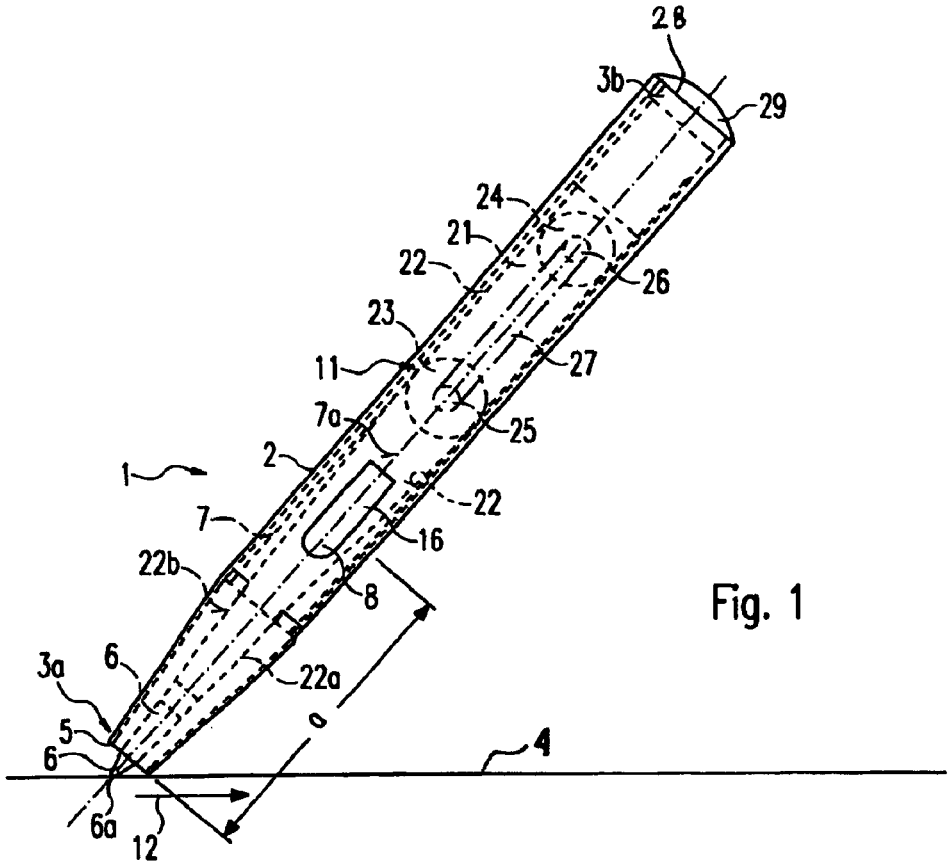
FIG. 1 shows a side view of the hand-held device as per the invention in its position adopted in the use function.

The hand-held device referred to generally as 1 has a rod or pen-shaped housing 2 which can, for example, exhibit a round or square cross-section. Referring to FIG. 1, housing 2 is illustrated in its use position, in which its front end 3*a* is directed diagonally downwards against a substrate 4 indicated by a horizontal line. Housing 2 comprises an opening 5 at its front end 3*a* for receiving an application member 6—for example a pen or spatula-shaped application member—mounted in housing 2. Housing 2 is preferably tapered and blunted in a wedge shape. Preferably housing 2 is mounted such as to be displaceable back and forth between a retracted parked position in housing 2 (FIG. 2) and an application position (FIG. 1) where the application end 6*a* projects out of the housing 2. A straight lengthways guide 7 for the application member 6 is arranged in the housing 2 to serve this purpose. A manually operable actuating element 8 is provided for moving the application member 6 between its parked position and its application position. Actuating element 8 is preferably arranged on a side surface 2*a* of housing 2 and is moveable between a stand-by position (FIG. 2) and an active position (not illustrated), wherein, when actuating element 8 is actuated and moved, it activates the application member 6 to move into its application position. After the movement of the application member 6 into its application position, the application member 6 remains in the application position where it is positioned by suitable positioning elements. The actuating element 8, on the other hand, is moved back into its stand-by position by a return spring 9 as soon as the user lets go of actuating element 8. The forwards and backwards movement of the application member 6 is indicated by double-headed arrow 10, in FIGS. 2 and 3.

When the application member 6 is in its application position, as illustrated in FIG. 1, the hand-held device 1 can be used to apply a film onto the substrate 4. In this way, the film is conveyed from a film supply 11 disposed in housing 2 to the application end 6*a* of the application member 6, from which the film is applied onto the substrate 4 by an application movement 12 along the substrate 4 with the user's hand applying light manual pressure against the substrate 4.

For the application member 6 to be moved back into its parked position, the actuating element 8 again has to be moved from its stand-by position into its active position. In doing so, the application member 6 is activated to move backwards into its parked position.

Figure 2:
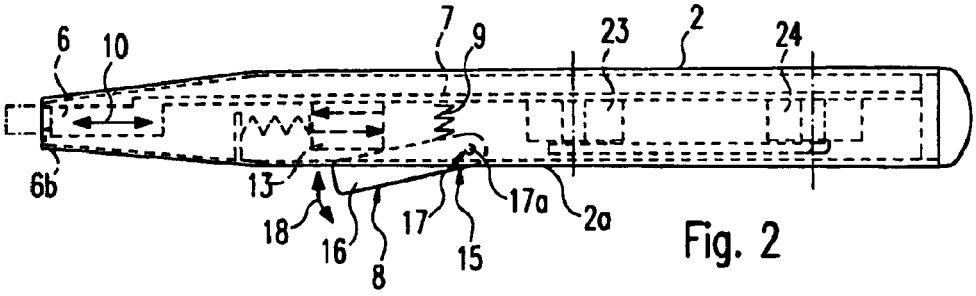
FIG. 2 shows the hand-held device according to claim 1 as viewed from above.

A diagrammatically illustrated device 13 for changing the direction of movement is provided for transferring the movement of the actuating element 8 onto the application member 6. The motion transfer can be formed such that either the forwards movement of the application member 6 between its parked position and its application position or the backwards movement between its application position and its parked position is performed during the movement of the actuating element 8 into its active position. In doing so, a spring 14 can be used and put under tension with the spring resistance of this spring being capable of serving the counter movement of the application member. The device 13, also referred to as a transfer device, is positioned between the actuating element 8 and the application member 6. The transfer device 13 includes a pressure surface in the form of a slanted plane or a curve as shown in FIGS. 1 and 2.

Within the context of the invention, it is possible to arrange and to mount the actuating element 8 such that its back and forth movement between its stand-by position and its active position is directed transversely to the central or longitudinal axis 7*a* and longitudinal guide 7. For this purpose, a transverse guide 15 can be provided for the actuating element 8. In the embodiment exemplified in FIGS. 1 and 2, the actuating element 8 is a lever arm 16 extending substantially along the length of hand-held device 1 which is swivellably mounted about a transverse swivel axis 17*a* in a pivot bearing 17 located in the vicinity of the periphery of the housing 2 and is positioned in its final pivoted position by stops. The return spring 9 assigned to the actuating element 8 can be disposed transversely to the longitudinal guide 7 in the housing 8 and be supported on the housing and act against the inner side of the actuating element 8. The motion transfer device 13 can, for example, be the type of mechanism commonly used in ball point pens which, during a first movement of the actuating element 8 from its stand-by position into its active position simultaneously moves the application member 6 into its application position after which the actuating member 8 returns to its stand-by position under the force of the spring 14 and in its second actuation activates the application member 6 such that it is moved back into its parked position by the spring resistance stored during the first movement.

The motion transfer device 13 can also work in the reverse fashion as well, i.e., it can be formed such that the application member 6 is activated to move into its application position during the first movement of the actuating element 8 from a stand-by position into an active position, whereby the positioning of the application member 6 is released and the application member 6 is pushed into its application position, by the force of a spring, for example. After it has been released manually, the actuating element 8 is moved back into its stand-by position by the force of the spring 9. The next time the actuating member 8 is actuated, the application member 6 is pushed back into its parked position during this movement and the aforementioned spring is put under tension. The lateral backwards and forwards movement of the actuating element 8 is indicated by a double-headed arrow 18.

Figure 3:
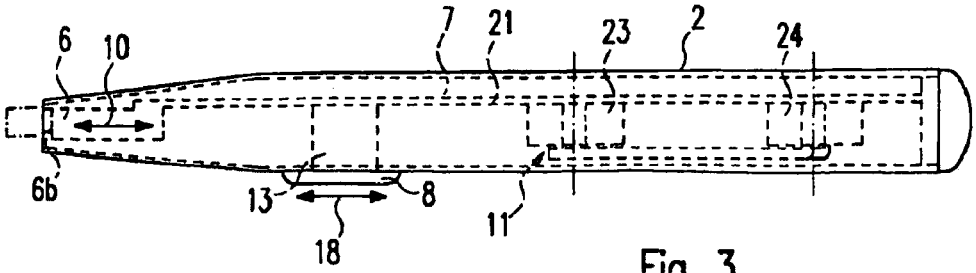
FIG. 3 shows a plan view of a modified embodiment of the hand-held device according to the invention.

In the embodiment exemplified in FIG. 3, in which the same or comparable parts are given the same reference numbers, the backwards and forwards movements 18 of the actuating element 8 are directed along or parallel to the longitudinal guide 7 and axis 7*a*. In this embodiment, the device 13 for changing the direction of movement can be formed in the form of a carrier which carries the application member 6 when the actuating element 8 is moved between its stand-by position and its active position. This carrying motion can be the forwards movement of the application member 6 into its application position or the backwards movement into its parked position. The actuating element 8 can be disposed and mounted such that it can be moved forwards or backwards between its stand-by position and its active position. Also, in this embodiment, positioning elements for the application member 6 are provided in the parked position and the application position to prevent unintentional movement from the position concerned into the other position. Similar to the embodiment exemplified in FIG. 2, it is also possible in the embodiment exemplified in FIG. 3 to simultaneously move the application member 6 into its application position, in which it is positioned, by moving the actuating element 8 forwards into its active position, wherein the actuating element 8 can then be moved back into its stand-by position either manually or with the aid of a spring. The next time the actuating element 8 is moved forwards into its active position, the positioning of the application member 6 can then be released and the application member 6 moved back, for example, by the force of a spring which has been stored up during the forwards movement.

In the exemplary embodiment according to FIG. 3, it is also possible to form the motion transfer device 13 such that, when the actuating element 8 is moved forwards into its active position, the application member 6 is simultaneously moved into its application position by means of slaving, and when the actuating element 8 is moved back into its stand-by position, the application member 6 is likewise moved into its parked position by means of slaving. In doing so, it is possible for the application member 6 and the actuating member 8 to form a motion unit which can be moved together. In this case, the positioning elements for positioning the application member 6 in its application position and its parked position can work together with the application member 6 or the actuating member 8 or add-on parts of the same.

The embodiments exemplified in FIG. 1 and FIG. 2 also allow the motion transfer device 13 to be formed such that the application member 6 is moved into its application position at the same time as the actuating element 8 is moved into its active position and is moved into its parked position at the same time as the actuating element 8 is moved into its stand-by position. Since, however, in this exemplified embodiment, the actuating member 8 and the application member 6 move transversely to each other, suitable positioning elements for the application member 6 need to be provided in the application member's parked position and application position and suitable positioning elements have to be provided for the actuating element 8 in at least its stand-by position or its active position.

It is possible for the user's hand to actuate the actuating member 8 in a user-friendly manner in both forwards and backwards directions 18. In the exemplified embodiment shown in FIG. 2, in which the direction of movement 18 of the actuating element 8 is directed transversely to the longitudinal axis, the actuating element 8 can be pressed in by a finger of the user's hand in the direction of the longitudinal axis 7*a*, the hand-held device 1 being held between at least two fingers of the user's hand and the (at least) one finger positioned on the other side of the hand-held device performing the function of skewback. In doing so, the housing 2 can remain in a held position. It is not necessary for a user to adjust the grip into a different holding position. The holding function and the actuating function differ merely in that the holding function exerts a lower amount of pressure and the actuating function exerts a larger amount of pressure. In the embodiment exemplified in FIG. 3, the hand-held device 1 is also held between at least two fingers of the user's hand to actuate the actuating element 8, but with the actuating element 8 being moved along the length of the hand-held device 1, the housing 2 being held by the (at least) one finger lying on the opposing side of the housing 1 on the latter. It is not necessary for a user to regrip the device in another holding position in this embodiment either.

The actuating element 8 can be arranged in a side position (as illustrated in FIG. 1) or on the top side or on the bottom side in both embodiments according to FIGS. 2 and 3. It is advantageous to arrange the actuating element 8 in the central longitudinal portion of the housing 2 or in the region of the front longitudinal half of the housing 2. In this section, the user's hand holds the housing 2 during application of the film such that it lies in a stable and ergonomically beneficial position in the user's hand. In addition, the appropriate finger of the user's hand can comfortably reach the actuating element 8 in this position region. A more ergonomically beneficial distance of the actuating element 8 from the front end 3*a* of the housing 2 is roughly 20 mm to 60 mm, preferably 30 mm to 40 mm. More specifically, in the hand-held device 1 shown, for example, in FIG. 1, the actuating element 8 is spaced between about 20 mm and 60 mm from the front end 3*a* of the housing 2. Moreover, in the hand-held device 1 shown, for example, in FIG. 1, the actuating element 8 is spaced between about 30 mm and 40 mm from the front end 3*a* of the housing 2. The film supply 11 is preferably disposed behind the actuating element 8. In order to improve the grip of the actuating element 8 in the embodiment illustrated in FIG. 3, the outer surface of the actuating element is roughened or provided with recesses or elevations, for example in the form of furrows.

In the exemplary embodiments illustrated in the drawings, the application member 6 is only arranged in the front end portion of the housing 2 and is guided on a laterally offset bearing member 21 extending rearwards from the housing 2. The bearing member 21 bears the film supply 11 and is formed by a leaf or strip-shaped guide member and can be displaceably guided back and forth in the diagrammatically illustrated longitudinal guide 7 in the longitudinal direction of the housing 2. The application member 6, the bearing member 21, and the film supply 11 form a motion unit which can be moved back and forth with the motion transfer device 13 interacting with the bearing member 21. More specifically, in the hand-held device 1 as shown, for example, in FIG. 1, when the application member 6 is disposed in a front end portion of the housing 2, the bearing member 21 extends linearly rearwards from the application member 6, the bearing member 21 bearing the film material supply 11. In addition, in the hand-held device as shown, for example, in FIG. 1, the bearing member 21 is laterally offset relative to the application member 6.

The film to be transferred onto the substrate 4 can be a free-flowing film, for example a liquid or pulpy film. In the exemplary embodiments set out above, the film is made up of a strip-shaped thin foil of solid yet flexible material which is releasably adhered to a backing tape 22, illustrated in FIG. 1, which extends from a supply reel 23 to the application end 6*a* of the application member 6 and extends about the application end 6*a* in the opposite direction to the direction of the application movement 12. The film strip of the backing tape 22 extending from the supply reel 23 towards the application end 6*a* is denoted as 22*a*. The outer side of the film is adhesive so that it adheres to the substrate.

When moving the hand-held device 1 in the application movement direction 12 on the substrate 4, the film adhering to the outer side of the backing tape 22 is detached from the application member 6 at the application end 6*a* by being pressed onto the substrate 4 and adhering thereto. The section of the backing tape 22 separated from the film is preferably wound back up by a take-up reel 24 disposed in the housing 2, wherein it is guided into the housing 2 on the other side of the application member 6 in the form of an opposing film strip 22*b* to the take-up reel and is wound up there.

In this exemplary embodiment, the supply reel 23 and the take-up reel 24 are disposed behind one another with their rotational axes extending parallel to the tip 6*b* of the application member 6. The take-up reel 24 can be arranged behind the supply reel 23. The pivot bearings for the supply reel 23 and the take-up reel 24 can each be formed by a bearing axis 25, 26 protruding from the bearing member 21 on which the associated reel is freely rotatably mounted with a bearing hole.

The supply reel 23 is driven by the run-off strip 22*a* unwinding from the reel during transfer of the film. To guarantee continuous take-up of the return strip 22*b* in spite of changing unwinding and take-up diameters, the reels 23, 24 are connected to each other by a diagramatically illustrated drive connection 27 integrating a sliding coupling 26 which limits the driving force to a level which is sufficient to continuously pull in the strip 22*b* to be taken up and thus to avoid a loop being formed. This is achieved by the drive connection 27 driving the take-up reel 24 at such a speed that the take-up reel 24 attempts to take up the return strip 22*b* at a speed which is always greater than the unwinding speed, wherein the sliding coupling always guarantees slightly taut take-up of the strip 22*b*. Such a drive connection 27 having a sliding coupling is known per se and therefore does not need to be described in any more detail.

The housing 2 comprises a further closable housing opening through which the bearing member 21 and its add-on parts can be fitted, dismounted, and exchanged so as to equip the hand-held device 1 with a new film supply 11 when the film supply has been used up. Such a housing opening can be formed by the housing 2 being divided lengthways and the two housing halves being releasable from each other and reconnectable with each other by a connection device. Such a housing opening 28 can also be arranged at the rear end 3*b* of the pen-shaped housing 2 and closable by means of a lid 29, as shown in FIG. 1.

Figure 4:
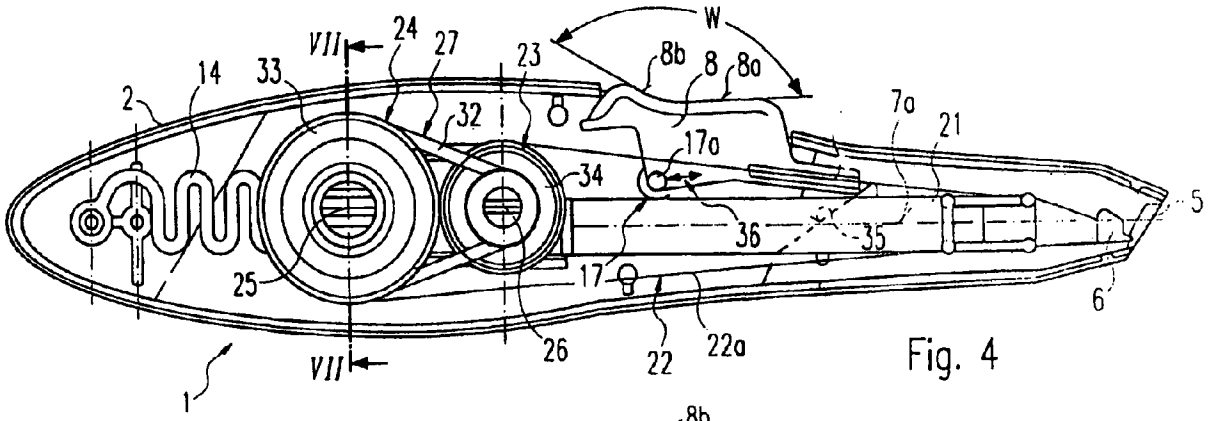
FIG. 4 shows a modified hand-held device as defined by the invention in a side view with an open housing.
Figure 5:
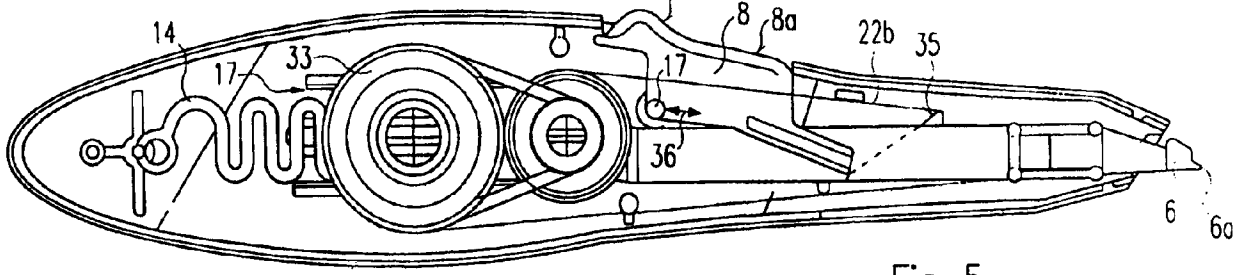
FIG. 5 shows the hand-held device illustrated in FIG. 4 in a different functioning position.
Figure 6:
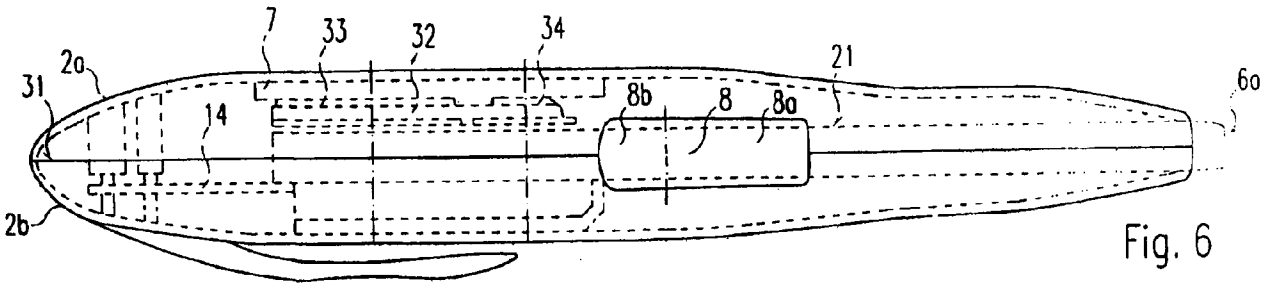
FIG. 6 shows the hand-held device of FIG. 4 as viewed from above.
Figure 7:
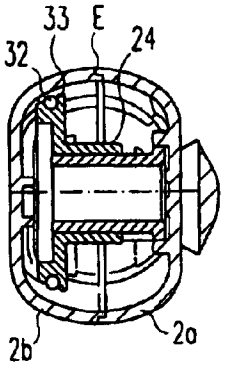
FIG. 7 shows the section VII—VII indicated in FIG. 4.

The embodiment exemplified in FIGS. 4 to 7, in which the same or comparable parts are provided with the same reference numbers, differs from the exemplary embodiments described above in several ways. The housing 2 may also be pen-shaped but it has a thickened central longitudinal section and is formed such that it diverges rearwardly to this thickened section so as to acquire a larger housing interior for reels 23, 24 with a larger receiving capacity. The housing may have a front end portion formed so as to converge towards the front end thereof in a truncated manner. The housing has a dividing joint 31 stretching roughly in the vertical longitudinal mid-plane, at which two shell-shaped housing parts 2*a*, 2*b* abut each other and are connected by releasable connecting means (not illustrated). In one exemplary embodiment, housing parts 2*a*, 2*b* are locked to one another by releasable latching means. As seen in FIGS. 4, 6 and 7, the housing 2 is wider in the transverse direction both transversely to the longitudinal mid-plane E and in the longitudinal mid-plane E with it having the flattened oblong cross-sectional shape parallel to the division plane E as shown in FIG. 7. This shape is advantageous with respect to the space required for reels 23, 24, the axial measurement of which is smaller than the measurement in the deflection plane of the backing tape 22. The housing interior is therefore advantageously exploited by the oblong cross-sectional form shown in FIG. 7 and thus the housing 2 can be realized with an optimal construction and size.

Exemplary actuating element 8 in the embodiment of FIGS. 4–7 is illustrated as a double-armed lever arm 16 mounted on transverse swivel axis 17*a* in pivot bearing 17. Lever arm 16 has a front actuating section 8*a* and a rear actuating section 8*b*. Actuating sections 8*a* and 8*b* enclose an obtuse angle W which opens towards the outside of housing 2. Swivel axis 17*a* is mounted such that it can be moved to and from guide 36 extending in the longitudinal direction of axis 7*a*. The device for changing the direction of movement arranged between actuating element 8 and application member 6 has a pressure surface 35 in the form of a slanted plane or a curve. More specifically, the lever arm 16 is a double-armed lever and includes first and second actuating sections disposed at an obtuse angle with respect to each other.

In the exemplified embodiment, the supply reel 23 is disposed behind the take-up reel 24. The drive connection 27 is formed by a belt drive with a belt 32 (O-ring) having a preferably circular cross-section which deflects about belt discs 33, 34 arranged laterally offset from one another in relation to the longitudinal mid-plane E or the backing tape 22. The sliding clutch can be formed by the belt drive sliding through when a certain torque is exceeded. The belt 32 is preferably made of elastic material, such as rubber or plastic, and deflects about the belt discs 33, 34 with elastic tensile stress.

What is claimed is:

1. A hand-held device for applying a film onto a substrate, said device comprising:

a housing in which a film material supply is disposed;

an application member having an application end to which the film material can be supplied, said application member being moveable back and forth between a retracted position in said housing, and an application position projecting out of the housing through an opening in the housing; and an actuating element manually moveable between a stand-by position and an active position;

wherein:

said actuating element activates said application member to move into said application position when said actuating element is moved into said active position;

said housing includes a side surface;

said actuating element is arranged on said side surface of said housing;

said actuating element moves transverse to the direction of movement of said application member;

a transfer device is positioned between said actuating element and said application member; and said transfer device includes a pressure surface in the form of a slanted plane or a curve which is contacted by said actuating element upon pressing thereof to thereby actuate said application member.

2. The hand-held device as in claim 1, wherein said housing includes a middle axis extending through said housing opening, and said actuating element is moveable transversely to said middle axis.

3. The hand-held device as in to claim 1, wherein said actuating element is disposed in the region of a front half of said housing.

4. The hand-held device as in claim 1, wherein said application end is a free end and is pointed or spatula-shaped.

5. A hand-held device for applying a film onto a substrate, said device comprising:

a housing in which a film material supply is disposed;

an application member having an application end to which the film material can be supplied, said application member being moveable back and forth between a retracted position in said housing and an application position projecting out of said housing through an opening in said housing; and an actuating element is manually moveable between a stand-by position and an active position and activates said application member to move into said application position when said actuating element is moved into said active position;

wherein:

said housing includes a central axis extending from a back end to a front end and through said housing opening;

said actuating element is moveable transversely to said central axis; and said actuating element is pivotably mounted in a pivot bearing and is pivotable about a swivel axis extending transversely to said central axis of said housing.

6. The hand-held device as in claim 5, wherein said actuating element is spaced between about 20 mm and 60 mm from the front end of said housing.

7. The hand-held device as in claim 6, wherein the actuating element is spaced between about 30 mm and 40 mm from the front end of said housing.

8. The hand-held device as in claim 5, wherein said application member is disposed in a front end portion of said housing and a bearing member extends linearly rearwards from said application member, said bearing member bearing the film material supply.

9. The hand-held device as in claim 8, wherein said bearing member is laterally offset relative to said application member.

10. The hand-held device as in claim 5, wherein said actuating element is a lever arm which can be manually activated by pivoting in two different directions about said swivel axis.

11. The hand-held device as in claim 10, wherein said lever arm is a double-armed lever and includes first and second actuating sections disposed at an obtuse angle with respect to each other.

12. The hand-held device as in claim 5, wherein a supply reel and a take-up reel are disposed behind each other.

13. The hand-held device as in claim 12, wherein said take-up reel is arranged behind said supply reel.

14. The hand-held device as in claim 5, wherein said housing has a flattened cross-sectional shape parallel to a dividing joint.

15. The hand-held device as in claim 5, wherein said swivel axis is mounted such that it can be moved longitudinally in a guide extending in the longitudinal direction of said central axis.

16. A hand-held device for applying a film onto a substrate, said device comprising:

a housing in which a film material supply is disposed;

an application member having an application end to which the film material can be supplied, said application member being moveable back and forth between a retracted position in said housing and an application position projecting out of said housing through an opening in said housing; and an actuating element is manually moveable between a stand-by position and an active position and activates said application member to move into said application position when said actuating element is moved into said active position;

wherein:

said housing includes a central axis extending from a back end to a front end and through said housing opening;

said actuating element is moveable transversely to said central axis;

a transfer device is positioned between said actuating element and said application member; and said transfer device includes a pressure surface in the form of a slanted plane or a curve which is contacted by said actuating element upon pressing thereof to thereby actuate said application member.

17. The hand-held device as in claim 5, wherein said application end is a free end and is pointed or spatula-shaped.

18. The hand-held device as in claim 5, wherein said housing is generally shaped like a pen.

19. The hand-held device as in claim 5, wherein said front end portion of said housing is formed so as to converge towards said front end in a truncated manner.

20. The hand-held device as in claim 5, wherein the film is formed by a film strip made of material which is releasably adhereable to the outer side of a backing tape, the backing tape extending from a supply reel from said application end of said application member and preferably extending back into said housing to a take-up reel.

21. The hand-held device as in claim 1, wherein a supply reel and a take-up reel are disposed behind each other.

22. The hand-held device as in claim 21, wherein said take-up reel is arranged behind said supply reel.

23. A hand-held device for applying a film onto a substrate, said device comprising:

a housing in which a film material supply is disposed;

an application member having an application end to which the film material can be supplied, said application member being moveable back and forth between a retracted position in said housing, and an application position projecting out of the housing through an opening in the housing; and an actuating element manually moveable between a stand-by position and an active position;

wherein:

said actuating element activates said application member to move into said application position when said actuating element is moved into said active position;

said housing includes a side surface;

said actuating element is arranged on said side surface of said housing; and said actuating element moves transverse to the direction of movement of said application member, wherein said housing has a dividing joint stretching roughly in a vertical longitudinal mid-plane of said housing.

24. The hand-held device as in claim 1, wherein said housing has a flattened cross-sectional shape parallel to a dividing joint.

25. A hand-held device for applying a film onto a substrate, said device comprising:

a housing in which a film material supply is disposed;

an application member having an application end to which the film material can be supplied, said application member being moveable back and forth between a retracted position in said housing, and an application position projecting out of the housing through an opening in the housing; and an actuating element manually moveable between a stand-by position and an active position;

wherein:

said actuating element activates said application member to move into said application position when said actuating element is moved into said active position;

said housing includes a side surface;

said actuating element is arranged on said side surface of said housing;

said actuating element moves transverse to the direction of movement of said application member;

said application member moves along a first axis;

said actuating element moves along a second axis transverse to said first axis; and said actuating element is swivellably mounted about a swivel axis transverse to said first axis.

26. A hand-held device for applying a film onto a substrate, said device comprising:

a housing in which a film material supply is disposed;

an application member having an application end to which the film material can be supplied, said application member being moveable back and forth between a retracted position in said housing and an application position projecting out of said housing through an opening in said housing; and an actuating element is manually moveable between a stand-by position and an active position and activates said application member to move into said application position when said actuating element is moved into said active position;

wherein:

said housing includes a central axis extending from a back end to a front end and through said housing opening;

said actuating element is moveable transversely to said central axis; and said housing has a dividing joint stretching roughly in a vertical longitudinal mid-plane of said housing.

27. A hand-held device for applying a film onto a substrate, said device comprising:

a housing in which a film material supply is disposed;

an application member having an application end to which the film material can be supplied, said application member being moveable back and forth between a retracted position in said housing, and an application position projecting out of the housing through an opening in the housing;

an actuating element manually moveable between a stand-by position and an active position; and a transfer device positioned between said actuating element and said application member;

wherein:

said housing includes a side surface;

said actuating element is arranged on said side surface of said housing;

said actuating element activates said application member to move into said application position when said actuating element is moved into said active position;

said transfer device transfers movement of said actuating element onto said application member, said transfer device includes a pressure surface in the form of a slanted plane or a curve which is contacted by said actuating element upon pressing thereof to thereby actuate said application member.

28. A hand-held device for applying a film onto a substrate, said device comprising:

a housing in which a film material supply is disposed;

an application member having an application end to which the film material can be supplied, said application member being moveable back and forth between a retracted position in said housing and an application position projecting out of said housing through an opening in said housing; and an actuating element is manually moveable between a stand-by position and an active position and activates said application member to move into said application position when said actuating element is moved into said active position;

wherein:

said housing includes a central axis extending from a back end to a front end and through said housing opening; and said actuating element is a double-armed lever pivotably mounted in a pivot bearing and is pivotable about a swivel axis extending transversely to said central axis.

29. A hand-held device for applying a film onto a substrate, said device comprising:

a housing in which a film material supply is disposed, said housing having an opening defined at a front end and a middle axis extending through the housing opening;

an application member having an application end to which the film material is supplied, said application member being movable back and forth between a retracted parked position in said housing and an application position projecting out of said housing through said housing opening;

an actuating element arranged in a region of the front half of said housing and on a side surface of said housing, said actuating element being manually moveable between a stand-by position and an active position; and a motion transfer device arranged between said actuating element and said application member;

wherein:

said application member is disposed in the front end portion of said housing and a bearing member bearing the film material supply extends in a straight line rearwards from said application member;

said actuating element shifts said application member directly into its application position when said actuating element is moved into said active position;

said actuating element moves only transversely to the middle axis of said housing between said stand-by position and said active position, said motion transfer device converts lateral movement of said actuating element into a longitudinal movement of said application member; and the film material supply is disposed behind said actuating element.

* * * * *